US005516464A

United States Patent [19]

Jones

[11] Patent Number: 5,516,464

[45] Date of Patent: May 14, 1996

[54] CHARGE-FORMING FUEL SYSTEM FOR AN INTERNAL COMBUSTION ENGINE

[76] Inventor: James M. Jones, 413 W. Jefferson, Waxahachie, Tex. 75165

[21] Appl. No.: 408,685

[22] Filed: Mar. 21, 1995

[51] Int. Cl.[6] ..... F02M 7/04

[52] U.S. Cl. ..... 261/69.2

[58] Field of Search ..... 261/69.2

[56] References Cited

U.S. PATENT DOCUMENTS

| | | | |
|---|---|---|---|
| 2,316,327 | 4/1941 | Garretson | 261/69 |
| 2,372,306 | 3/1945 | Adair | 261/69 |
| 2,509,994 | 5/1950 | Stresen-Reuter | 261/69.2 |
| 2,953,361 | 9/1960 | McDuffie | 261/69.2 |
| 3,009,794 | 11/1961 | Barfod | 48/184 |
| 3,174,470 | 3/1965 | Von Seggern et al. | 261/69.2 |
| 3,618,904 | 11/1971 | Woods | 261/69.2 |
| 3,743,254 | 7/1973 | Tuckey | 261/69.2 |
| 4,632,788 | 12/1986 | Jones | 261/41.5 |
| 4,965,023 | 10/1990 | Jones | 261/69.2 |

FOREIGN PATENT DOCUMENTS

| | | | |
|---|---|---|---|
| 813406 | 6/1937 | France | 261/69.2 |

*Primary Examiner*—Tim R. Miles
*Attorney, Agent, or Firm*—Jenkens & Gilchrist

[57] ABSTRACT

A single pivoting diaphragm plate is utilized to separate the two air-sensing chambers and the two fuel-sensing chambers. The diaphragm plate is bonded to a resilient diaphragm/seal which separates and seals the four chambers and allows for the pivoting action of the diaphragm plate as it seeks to balance the forces of the air velocity and the fuel velocity. Any imbalance between the forces is sensed across the diaphragm plate, which immediately results in a pivoting movement to return the system to a balanced condition. The pivoting action of the diaphragm plate controls the fuel discharge valve which feeds fuel into an accelerated air passageway which enters the main air stream below a throttle plate.

11 Claims, 2 Drawing Sheets

CHARGE-FORMING FUEL SYSTEM FOR AN INTERNAL COMBUSTION ENGINE

BACKGROUND

Field of the Invention

The present invention relates to liquid fuel feed systems for internal combustion engines, and more particularly to charge-forming devices which balance the forces of an air flow rate with the forces of a fuel flow rate across one or more sensing diaphragms in order to properly position a fuel discharge valve.

HISTORY OF THE PRIOR ART

The typical charge-forming device utilizes two opposing diaphragms, an air-sensing diaphragm, and a fuel-sensing diaphragm. An air-sensing diaphragm senses the ambient air pressure on one side, and the air pressure of a venturi throat on the other side; this pressure difference represents the air velocity through the main air venturi. A fuel-sensing diaphragm senses the inlet fuel pressure on one side, and the downstream fuel pressure past a fuel orifice on the other side; this pressure difference represents the fuel velocity through the system. The air-sensing diaphragm is interconnected with the fuel-sensing diaphragm by means of an actuating rod which also controls the fuel discharge valve. The opposing forces acting across the two diaphragms seek to balance one another in order to properly maintain the correct fuel flow across the fuel discharge valve. Any imbalance between the two diaphragms results in a repositioning of the diaphragms which in turn repositions the open area of the fuel discharge valve.

SUMMARY

The present invention utilizes a pivoting diaphragm plate which mounts between the main body of the device and a diaphragm bonnet, and forms four separate chambers. A diaphragm/seal is bonded to the diaphragm plate and allows for the pivoting motion necessary to throttle the fuel discharge valve. Fuel enters a fuel inlet and crosses a filter before entering the primary fuel chamber. The fuel then crosses the fuel orifice, which is located in the diaphragm plate, and fills the secondary fuel chamber. The fuel discharge valve is formed by a portion of the diaphragm-seal which is bonded to the diaphragm plate, and which seats against the fuel discharge tube.

The upper two chambers are the air-sensing chambers. Ambient air pressure acts upon one chamber and the air pressure from the venturi throat acts upon the other chamber. During periods of non-operation, the fuel discharge valve is closed due to the action of a spring-loaded closing diaphragm and plunger assembly. When the engine is cranked, a light vacuum will collapse the closing diaphragm and plunger assembly, which allows the pressure depression from the throat of the venturi to act upon the pivoting diaphragm plate. The venturi pressure depression causes the diaphragm plate to pivot, which opens the fuel discharge valve. The fuel then enters the accelerated air passage which delivers the fuel below the throttle plate and allows the engine to start.

Once the engine starts, the forces of the air flow rate and the fuel flow rate act upon the pivoting diaphragm plate. These forces seek to balance one another in order to deliver the proper amount of fuel. Any imbalance between the forces acting upon the pivoting diaphragm plate results in a repositioning movement which rebalances the forces to assure the proper fuel flow. For example, should the throttle plate opening increase, the air flow rate through the main air venturi will increase and cause an imbalance which is sensed across the pivoting diaphragm plate. This is due to the increased venturi vacuum within the venturi depression chamber which acts upon the pivoting diaphragm plate. The diaphragm plate will then pivot towards the venturi depression chamber which also increases the open area across the fuel discharge valve, which results in an increase in the fuel velocity. The movement of the pivoting diaphragm plate returns the system to a balanced condition which assures the proper balance of air to fuel.

In one embodiment, the charge forming system of the present invention includes a body having a passage, a first chamber, and a second chamber. The passage in the body includes a venturi with a throat. A diaphragm separates the first chamber of the body into a venturi depression chamber and a free air chamber. The diaphragm also separates the second chamber of the body into a primary fuel chamber and a secondary fuel chamber. The diaphragm is pivotally mounted to the body such that rotation of the diaphragm in a first direction rotates the diaphragm towards the free air chamber and towards the secondary fuel chamber, and that rotation of the diaphragm in a second direction rotates the diaphragm towards the venturi depression chamber and towards the primary fuel chamber. The free air chamber is in fluid communication with substantially ambient air, and the venturi depression chamber is in fluid communication with the throat of the venturi. The primary fuel chamber receives the fuel flow of the charge forming fuel system and is in fluid communication with the secondary fuel chamber, and the secondary fuel chamber is in fluid communication with the passage in the body. A means for restricting the fuel flow restricts flow between the primary fuel chamber and the secondary fuel chamber. A means for controlling the fuel flow rate controls the fuel flow based on the angular position of the diaphragm, wherein rotation of the diaphragm towards the primary fuel chamber and the venturi depression chamber increases the fuel flow ram through the charge forming system, and a rotation of the diaphragm towards the secondary fuel chamber and the free air chamber decreases the fuel flow rate through the charge forming fuel system.

In a further embodiment, the means for restricting the fuel flow includes an aperture in the diaphragm between the primary fuel chamber and the secondary fuel chamber. In another further embodiment, the venturi depression chamber is in fluid communication with the throat of the venturi through a vacuum passageway, and a power trim screw adjustably restricts fluid communication between the vacuum passageway and an air passage which is in fluid communication with substantially ambient air.

In another further embodiment, the charge forming fuel system includes a throttle plate disposed in the passage of the body and controlling the air flow rate therethrough, an air and fuel passage in the body which is in fluid communication with substantially ambient air and in fluid communication with the passage of the body below the throttle plate, and an air orifice disposed within the air and fuel passage, wherein the fuel flowing through the charge forming fuel system is discharged into the air and fuel passage between the air orifice and the passage of the body. In a further embodiment, the body has an idle passage in fluid communication with the venturi throat and in fluid communication with the air and fuel passage, and an idle trim screw adjustably restricts the fluid communication between the air and fuel passage and the venturi depression chamber.

In another embodiment, the means for controlling the fuel flow rate includes a fuel valve seat disposed on the diaphragm, and a fuel discharge passage in which the fuel flows from the secondary fuel chamber to the passage of the main body. The fuel valve seat is positioned on the diaphragm such that rotation of the diaphragm towards the secondary fuel chamber increases the restriction of the fuel flow through the fuel discharge passage, and that rotation of the diaphragm towards the primary fuel chamber reduces the restriction of the fuel flow through the discharge passage. In yet a further embodiment, a diaphragm plunger assembly separates an air chamber from a vacuum chamber and is positioned such that movement of the diaphragm plunger towards the air chamber causes the diaphragm plunger assembly to force the diaphragm so as to close the fuel valve seat against the field discharge passage, and movement of the diaphragm plunger assembly towards the vacuum chamber causes the diaphragm plunger assembly to release the diaphragm and allow the fuel valve seat to separate from the fuel discharge passage.

DETAILED DESCRIPTION

Figure 1:
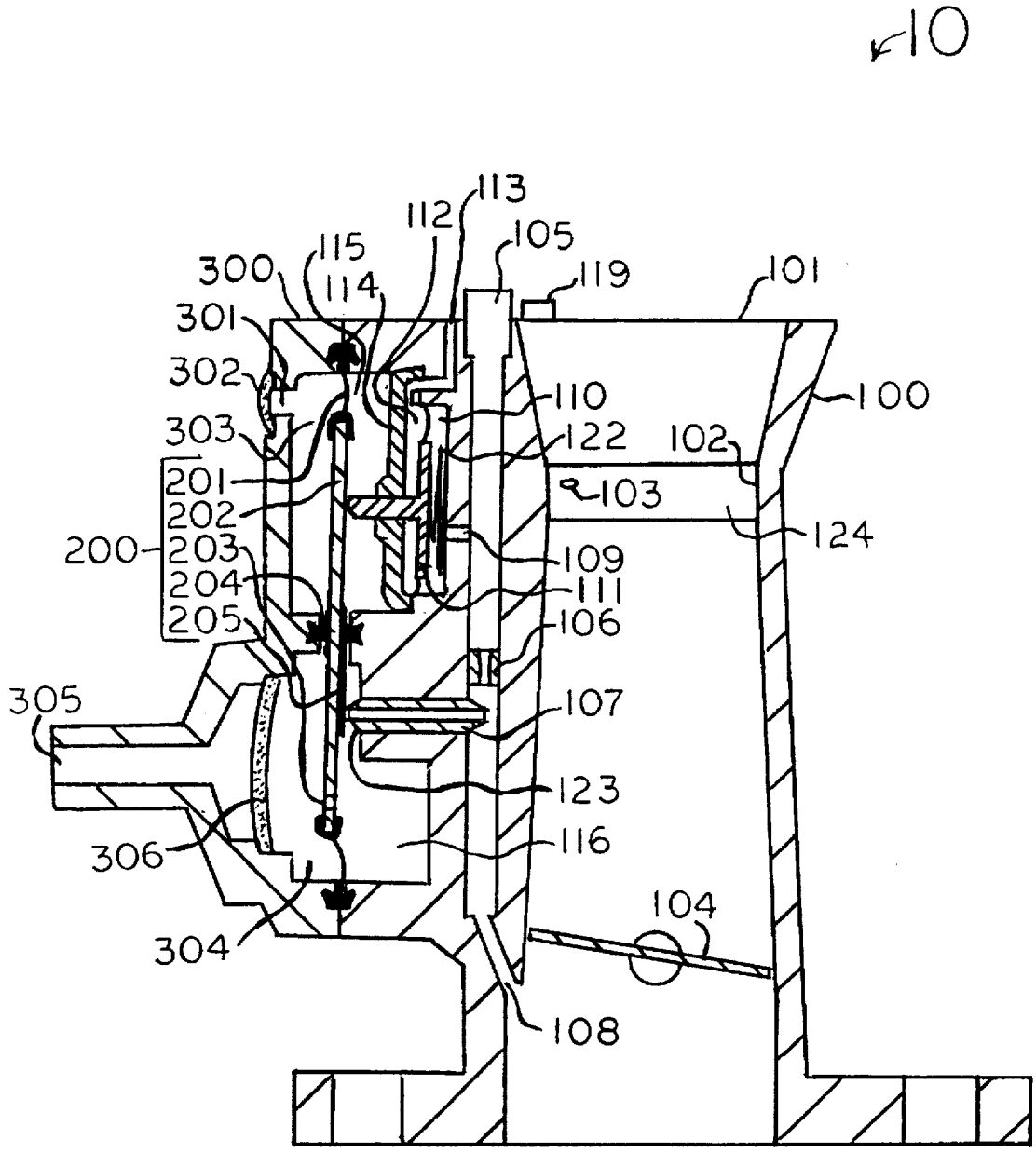
FIG. 1 is a side elevation sectional view illustrating the major components of the present invention.

FIG. 1 illustrates an improved charge forming fuel system 10 including a main body 100, a main air entrance 101, a main air venturi 102, a venturi depression port 103, a throttle plate 104, and an air and fuel passage 105. The air moving into the passage 105 is accelerated across an air orifice 106 before it meets the discharged fuel at a fuel discharge passage or tube 107. The resulting air-fuel blend enters the main air stream across a discharge port 108 below the throttle plate 104.

A port 109 provides a vacuum source to a vacuum chamber 110, which is formed between the main body 100 and a closing diaphragm plunger assembly 111. An ambient air chamber 112 is formed between the closing diaphragm plunger assembly 111 and a cover 114. The ambient air chamber 112 is vented by a passage 113. A light closing spring 122 forces the closing diaphragm plunger assembly 111 towards the chamber 112 when the charge forming fuel system 10 is at rest.

Figure 3:
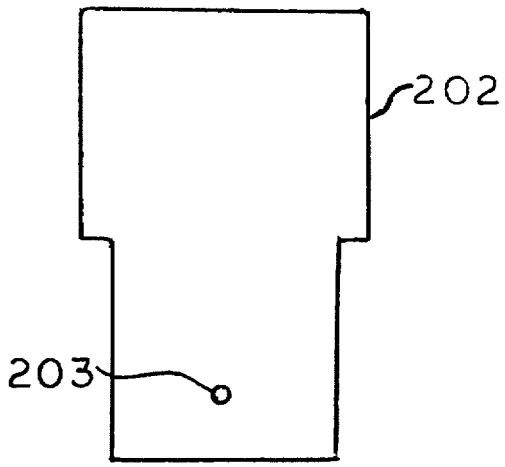
FIG. 3 is a elevational view of the metal diaphragm plate and its fuel orifice.

FIGS. 1 and 3 illustrate a pivoting diaphragm assembly 200 of the present invention. The pivoting diaphragm assembly 200 comprises a formed diaphragm/seal 201, which is bonded to a metal diaphragm plate 202, and a fuel orifice 203. The diaphragm/seal 201 also forms a pivotal axis 204 and a fuel valve seat 205 which seats against the fuel discharge tube 107. The main body 100 and the diaphragm assembly 200 form a venturi depression chamber 115 and a secondary fuel chamber 116.

A bonnet 300 includes a vent hole 301 with a filter 302, and forms an ambient air chamber 303 and a primary fuel chamber 304 with the diaphragm assembly 200. Fuel enters a fuel inlet 305 and crosses a filter 306 into the primary fuel chamber 304. The fuel then crosses the fuel orifice 203 and fills the secondary fuel chamber 116.

Figure 2:
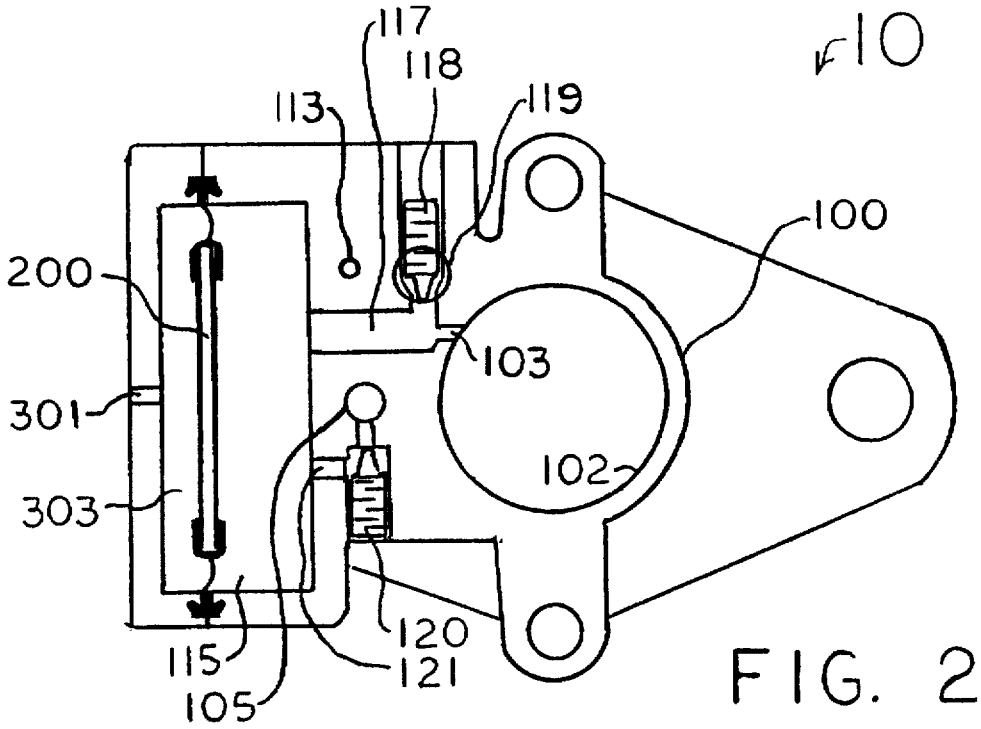
FIG. 2 is a schematic illustration of the top of the system revealing the various air and vacuum passages and their respective trim devices.

FIG. 2 illustrates various air and vacuum passages of the charge forming fuel system 10. A vacuum passageway 117 connects the venturi depression port 103 in the throat 124 of the venturi 102, i.e., the narrow section of the venturi, with the venturi depression chamber 115. A power trim screw 118 bleeds down the venturi depression signal with free air from a free air passage 119 (also shown in FIG. 1). An idle trim screw 120 is provided to control a bleed between the air and fuel passage 105 and the venturi depression chamber 115 through a passage 121.

Referring to FIGS. 1, 2, and 3, the operation of the charge forming fuel system 10 can be described. The pivoting diaphragm assembly 200 senses the forces of the air flow rate and the forces of the fuel flow rate and balances them against one another in order to provide the proper air-fuel blend to meet the demands of the engine. The flow rate of the air moving into the main air entrance 101 is sensed as a vacuum through the venturi depression port 103. This vacuum acts upon the venturi depression chamber 115 through the vacuum passage 117. Ambient air pressure in the ambient air chamber 303 acts upon the pivoting diaphragm assembly 200 through the vent hole 301. An increase in the air flow rate through the venturi 102 results in an increase of vacuum within the venturi depression chamber 115, which causes the greater pressure within the ambient air chamber 303 to force the diaphragm assembly 200 to pivot towards the chamber 115. This pivoting action along the pivotal axis 204 also increases the open area between the fuel valve seat 205 and the fuel discharge tube 107, thereby increasing the fuel flow rate to meet the increased demand.

The fuel flow rate is sensed across the fuel orifice 203 of the diaphragm assembly 200. The fuel orifice 203 of the diaphragm assembly 200 causes the pressure in the primary fuel chamber 304 to be larger than the pressure in the secondary fuel chamber 116 as fuel flows through the charge forming system 10. An increase in the fuel flow rate will cause a greater pressure difference between the primary fuel chamber 304 and the secondary fuel chamber 116. A decrease in the fuel flow rate will cause a lower pressure difference between the primary fuel chamber 304 and the secondary fuel chamber 116. Any imbalance of forces acting upon the chambers 115,303, 116, and 304 results in a corresponding rebalancing movement of the diaphragm assembly 200, which adjusts the open area between the fuel valve seat 205 and the fuel discharge tube 107 to assure a proper air-fuel blend.

During non-operational periods of the charge forming fuel system 10, the absence of a vacuum to the chamber 110 causes the spring 122 to force the closing diaphragm plunger assembly 111 against the diaphragm assembly 200, which seats the fuel valve seat 205 against the fuel discharge tube 107. This movement stops the flow of fuel and also leaves none of the fuel within the charge forming fuel system 10 exposed to the ambient air. Once vacuum from an engine manifold (not shown) is sensed by the chamber 110, the diaphragm plunger assembly 111 moves away from the diaphragm assembly 200, thereby allowing the diaphragm assembly 200 to pivot and fuel to pass through the fuel discharge tube 107.

The charge forming fuel system 10 as described is a very simple and compact unit. In one embodiment the angular movement of the pivoting diaphragm assembly is only three degrees. This small movement results in a very responsive and accurate charge forming system.

It is thus believed that the operation and construction of the present invention will be apparent form the foregoing description of a preferred embodiment. While the device and method shown are described as being preferred, it will be obvious to a person of ordinary skill in the art that various changes and modifications may be made therein without departing from the spirit and scope of the invention as defined in the following claims. For example, the present invention can be adapted to other configurations, such as two or four barrel systems. Therefore, the spirit and scope of the appended claims should not be limited to the description of the preferred embodiments contained herein.

What is claimed is:

1. A charge forming fuel system comprising:

a body including a passage, a first chamber, and a second chamber, the passage having a venturi with a throat;

a diaphragm separating the first chamber of said body into a venturi depression chamber and a free air chamber, and separating the second chamber of said body into a primary fuel chamber and a secondary fuel chamber, said diaphragm being pivotally mounted to said body such that rotation of said diaphragm in a first direction rotates said diaphragm towards the free air chamber and towards the secondary fuel chamber, and such that rotation of said diaphragm in a second direction rotates said diaphragm towards the venturi depression chamber and towards the primary fuel chamber, wherein the free air chamber is in fluid communication with substantially ambient air, wherein the venturi depression chamber is in fluid communication with the throat of the venturi, wherein the primary fuel chamber receives the fuel flow of said charge forming fuel system and is in fluid communication with the secondary fuel chamber, and wherein the secondary fuel chamber is in fluid communication with the passage in the body;

means for restricting the fuel flow between the primary fuel chamber and the secondary fuel chamber;

means for controlling the fuel flow rate from the secondary fuel chamber to the passage responsive to the angular position of said diaphragm, wherein rotation of said diaphragm towards the primary fuel chamber and the venturi depression chamber increases the fuel flow rate and rotation of said diaphragm towards the secondary fuel chamber and the free air chamber decreases the fuel flow rate.

2. The charge forming fuel system according to claim 1, wherein said means for restricting the fuel flow between the primary fuel chamber and the secondary fuel chamber comprises an aperture in said diaphragm positioned between the primary fuel chamber and the secondary fuel chamber.

3. The charge forming fuel system according to claim 1, wherein the venturi depression chamber is in fluid communication with the throat of the venturi through a vacuum passageway, wherein an air passage in the body is in fluid communication with substantially ambient air and in fluid communication with the vacuum passageway, and wherein a power trim screw is positioned within the body to adjustably restrict the fluid communication between the air passage and the vacuum passageway.

4. The charge forming fuel system according to claim 1, further comprising:

a throttle plate, said throttle plate being disposed within the passage of said body and controlling an air flow rate therethrough;

an air and fuel passage in said body, the free air passage being in fluid communication with substantially ambient air and being in fluid communication with the passage in said body below said throttle plate;

an air orifice disposed within the air and fuel passage in said body;

wherein said fuel flowing through said charge forming fuel system is discharged into the air and fuel passage between the air orifice and the passage of said body before being discharged into the passage of said body.

5. The charge forming fuel system according to claim 4, wherein the body has an idle passage in fluid communication with the venturi depression chamber and in fluid communication with the air and fuel passage, and wherein an idle trim screw is positioned within the body to adjustably restrict the fluid communication between the air and fuel passage and the venturi depression chamber.

6. The charge forming fuel system according to claim 1, wherein said means for controlling the fuel flow rate includes a fuel valve seat disposed on said diaphragm and a fuel discharge passage, wherein fuel flowing from the secondary fuel chamber to the passage of said main body flows through the fuel discharge passage, and wherein the fuel valve seat is positioned on said diaphragm such that rotation of said diaphragm towards the secondary fuel chamber increases the restriction of the fuel flow through the fuel discharge passage, and such that rotation of said diaphragm towards the primary fuel chamber reduces the restriction of the fuel flow through the fuel discharge passage.

7. The charge forming fuel system according to claim 6, further including:

a diaphragm plunger assembly separating an air chamber from a vacuum chamber, said vacuum chamber being in fluid communication with the passage in said body and said air chamber being in fluid communication with substantially ambient air, wherein said diaphragm plunger assembly, said air chamber, and said vacuum chamber are positioned such that said diaphragm plunger assembly contacts said diaphragm and forces said diaphragm to close said fuel valve seat against said fuel discharge passage as said diaphragm plunger extends into said air chamber, and to release said diaphragm to allow the fuel valve seat to separate from said fuel discharge passage as said diaphragm plunger extends into said vacuum chamber; and a spring applying force to said diaphragm plunger assembly towards the air chamber.

8. The charge forming fuel system according to claim 7, wherein said means for restricting the fuel flow between the primary fuel chamber and the secondary fuel chamber comprises an aperture in said diaphragm positioned between the primary fuel chamber and the secondary fuel chamber.

9. The charge forming fuel system according to claim 8, further comprising:

a throttle plate, said throttle plate being disposed within the passage of said body and controlling an air flow rate therethrough;

a free air passage in said body, the free air passage being in fluid communication with substantially ambient air and being in fluid communication with the passage in said body below said throttle plate;

an air orifice disposed within the free air passage in said body;

wherein said fuel flowing through said charge forming fuel system is discharged into the free air passage between the air orifice and the passage of said body before being discharged into the passage of said body.

10. The charge forming fuel system according to claim 9, wherein the body has an idle passage in fluid communication with the venturi depression chamber and in fluid communication with the free air passage, and wherein an idle trim screw is positioned within the body to adjustably restrict the fluid communication between the free air passage and the venturi depression chamber.

11. The charge forming fuel system according to claim 10, wherein the venturi depression chamber is in fluid communication with the throat of the venturi through a vacuum passageway, wherein an air passage in the body is in fluid communication with substantially ambient air and in fluid communication with the vacuum passageway, and wherein a power trim screw is positioned within the body to adjustably restrict the fluid communication between the air passage and the vacuum passageway.

* * * * *

UNITED STATES PATENT AND TRADEMARK OFFICE

CERTIFICATE OF CORRECTION

PATENT NO. : 5,516,464

DATED : May 14, 1996

INVENTOR(S) : James M. Jones

It is certified that error appears in the above-indentified patent and that said Letters Patent is hereby corrected as shown below:

| | | |
|---|---|---|
| Column 2, line 40 | Delete "ram" | Insert --rate-- |

Signed and Sealed this

Tenth Day of December, 1996

*Attest:*

*Attesting Officer*

BRUCE LEHMAN

*Commissioner of Patents and Trademarks*